US007005012B2

(12) United States Patent
Bourrelly et al.

(10) Patent No.: US 7,005,012 B2
(45) Date of Patent: Feb. 28, 2006

(54) DEVICE AND METHOD FOR BRUSH-CLEANING A TUBE USING A SPRAY SYSTEM TAKEN INTO THE TUBE

(75) Inventors: Bernard Bourrelly, Lesigny (FR); Jacques Vadot, Paris (FR)

(73) Assignee: R. Marchal & Cie, Montreuil sous Bois (FR)

( * ) Notice: Subject to any disclaimer, the term of this patent is extended or adjusted under 35 U.S.C. 154(b) by 112 days.

(21) Appl. No.: 10/450,292

(22) PCT Filed: Jun. 20, 2001

(86) PCT No.: PCT/FR01/01924

§ 371 (c)(1),
(2), (4) Date: Jun. 12, 2003

(87) PCT Pub. No.: WO02/47834

PCT Pub. Date: Jun. 20, 2002

(65) Prior Publication Data

US 2004/0025906 A1 Feb. 12, 2004

(30) Foreign Application Priority Data

Dec. 15, 2000 (FR) ..... 00 16375

(51) Int. Cl.
*B08B 9/04* (2006.01)

(52) U.S. Cl. ..... 134/8; 134/22.12; 15/104.05; 15/104.09; 15/104.12

(58) Field of Classification Search ..... 134/8, 134/22.1, 22.11, 22.12; 15/104.12, 104.05, 15/104.09, 104.095, 104.16, 104.2
See application file for complete search history.

(56) References Cited

U.S. PATENT DOCUMENTS

| | | | | |
|---|---|---|---|---|
| 4,027,349 A | * | 6/1977 | Clavin | 15/104.12 |
| 5,113,885 A | | 5/1992 | Ramsey | 134/167 |
| 5,813,089 A | * | 9/1998 | Nolan et al. | 15/383 |

FOREIGN PATENT DOCUMENTS

| | | | |
|---|---|---|---|
| DE | 2 491 785 | | 4/1982 |
| FR | 2491785 | * | 4/1980 |
| GB | 2 152 622 A | | 8/1985 |
| GB | 2 159 911 A | | 12/1985 |

* cited by examiner

*Primary Examiner*—Michael Barr
*Assistant Examiner*—Saeed Chaudhry
(74) *Attorney, Agent, or Firm*—Sutherland Asbill & Brennan LLP

(57) ABSTRACT

The device includes a spray system for spraying a fluid against the inside periphery of the tube to be cleaned, and two analogous brushing assemblies, each of which include brushing means and a propelling element which cooperates with the inside periphery of the tube. The device further includes means for moving axially the brushing assemblies towards and away from each other in alternation, which means include a chamber connected to a feed for feeding in fluid under pressure. The spray system includes a reservoir put under pressure by being connected to the chamber. A method of cleaning a tube, in which two brushing assemblies including brushing means are inserted into the tube and are moved towards and away from each other in alteration. A fluid, disposed in a reservoir cooperating with a support system on which the propelling elements are secured, is sprayed against the inside periphery of the tube.

26 Claims, 6 Drawing Sheets

DEVICE AND METHOD FOR BRUSH-CLEANING A TUBE USING A SPRAY SYSTEM TAKEN INTO THE TUBE

The present invention relates to device for cleaning a tube, said device comprising:

two analogous brushing assemblies, each of which comprises brushing means suitable for co-operating with the inside periphery of the tube, and a propelling element for moving said brushing means inside the tube;

means for moving axially the brushing assemblies towards each other and away from each other in alternation; and a spray system for spraying a fluid against the inside periphery of the tube.

The invention also relates to a method of cleaning a tube, in which method two analogous brushing assemblies are used, each of which comprises brushing means and a propelling element, said brushing assemblies are inserted successively into the tube via a first end of said tube, so that the brushing means co-operate with the inside periphery of the tube, said brushing means are moved and a brush and advance step is performed in which the brushing assemblies brush and advance towards the second end of the tube by moving the brushing assemblies towards each other and away from each other in alternation, and fluid is sprayed against said inside periphery of the tube.

The invention is particularly applicable to cleaning tubes of circular or substantially circular (e.g. oval) cross-section, and whose inside peripheries may be grooved. For example, the invention is applicable to cleaning gun barrels whose inside peripheries are provided with helical grooves.

BACKGROUND OF THE INVENTION

For the purpose of cleaning tubes, it is already known that it is possible to use a brush mounted on a rod controlled manually. For example, the rod serves to push the brush into the tube or a flexible cable is connected to the end of the brush to enable it to be pulled. For certain tubes having large dimensions (several meters (m) in length and greater than 10 centimeters (cm) in diameter), the physical force required to move the brush is large, and systems such as winches can be used to facilitate moving the brush inside the tube.

Systems have also been devised that apply pneumatic or hydraulic pressure to one side of the brush for the purpose of moving it. Such systems are relatively complicated to implement, and they require precautions to be taken when using them. In particular, when the brush is pushed very rapidly towards the outlet end of the tube by pneumatic pressure, it is necessary to provide means for retrieving said brush.

French Patent Application FR 2 491 785 discloses device in which each propelling element comprises a jack and a flexible cylindrical wall. The piston of the jack retracting deforms the wall so that it bears against the inside periphery of the tube.

That device is thus moved in the tube by controlling the two jacks of the two propelling assemblies in phase opposition, and, in addition, by moving the assemblies towards each other and away from each other in alternation by controlling a jack which interconnects the two assemblies.

Thus, that device includes three jacks so that its price is high and so that it is complicated to actuate since all three jacks must be controlled in synchronized manner.

A spray system can be provided for spraying a disinfectant liquid onto the wall of the duct to be cleaned. However, that spray system is connected via piping to a pump and to a reservoir containing the fluid to be sprayed, both of which are outside the duct.

The device of Document FR 2 491 785 is relatively complicated and would not appear to be suitable for cleaning grooved tubes.

SUMMARY OF THE INVENTION

An object of the present invention is to improve the existing techniques so as to propose device and a method that are simple and reliable, and that can be used and implemented easily, in particular for cleaning tubes with a fluid (cleaning fluid, lubricant, etc.) being sprayed.

This object is achieved with the device of the invention by the fact that said propelling element is suitable for co-operating with said inside periphery by being flexed along the axial direction D of the tube, by the fact that said brushing assemblies are mounted on a support system, by the fact that said means for moving axially the brushing assemblies towards each other and away from each other in alternation comprise a control chamber which is secured to said support system and which may be connected to a feed for feeding in fluid under pressure; and by the fact that said spray system includes a reservoir which co-operates with said support system and which can be put under pressure by being connected to said chamber. The fact the reservoir is secured to the support system makes it possible to avoid the presence of voluminous piping between the reservoir and the spray system, and to avoid the head loss due to the length of the link between the reservoir and the fluid outlet. Furthermore, no additional pressurizing system is necessary because the pressure of the control chamber is used directly to put the spray fluid under pressure.

Advantageously, the brushing means of a brushing assembly are suitable for turning freely relative to the brushing means of the other brushing assembly so that each of the brushing means can clean helical grooves formed in the inside periphery of said tube by advancing in the helical thread formed by said grooves.

This capacity of the brushing means to turn freely relative to each other is particularly advantageous because it gives the device the capacity to clean tubes whose inside peripheries are provided with helically-disposed grooves. It enables the brushing means to be guided in the grooves so as to clean them properly.

The spray system is advantageously secured to said brushing means of a brushing assembly.

Thus, when the brushing means turn, they simultaneously rotate the spray system, thereby causing the fluid to be sprayed via rotary jets.

Advantageously, the reservoir is provided with a filling orifice serving for filling said reservoir with fluid and said spray system is further provided with a fluid outlet having at least one spray nozzle distributed at the periphery of said support system for spraying said fluid against the inside periphery of the tube.

Thus, the reservoir is connected to at least one spray nozzle via a fluid outlet preferably provided in the support system.

Advantageously, the spray system also has a fluid outlet for spraying said fluid against the inside periphery of the tube, which outlet is provided with a plurality of spray nozzles distributed at the periphery of said support system, e.g. at one end thereof.

Care is taken to match the number and the distribution of the spray nozzles around the circumference of the support element so that the fluid can lubricate the entire inside periphery of the tube properly, in particular when the brushing means are not rotatably mounted.

In addition, the spray system may include specific rotary drive means that are particularly advantageous when the brushing means are not rotatably mounted. For example, the spray nozzles may be disposed on a ring which is free to turn relative to the brushing means under the effect of the pressure from the fluid.

Each of the propelling elements may, for example, comprise a plate (uninterrupted or interrupted) suitable for being deformed perpendicularly to its plane, i.e. along the axial direction of the tube, and/or a brushing element suitable for being deformed along the same direction. In both cases, the plate or the brushing element is advantageously substantially in the form of a disk.

With the invention, in order to clean a tube by using the brushing means, on inserting said brushing assemblies into the tube, care is taken to ensure that the two propelling elements co-operate with said inside periphery by being flexed axially towards the first end of the tube; said brushing assemblies are moved axially towards each other and away from each other in alternation by feeding at least one control chamber which is connected to a feed for feeding in fluid under pressure; said fluid is disposed in a reservoir that co-operates with said support system; and said fluid is put under pressure by using the pressure existing in said control chamber.

When a brushing assembly of the invention is inserted into the tube, the propelling element of said assembly flexes axially by taking up a curvature whose center faces towards the inlet the tube via which it is inserted. In other words, it can take up the form of a dish whose concave face faces the inlet of the tube.

When, after the first assembly has been inserted, the second brushing assembly is inserted into the tube via the same end as said first assembly, the propelling element of said second brushing assembly takes up the same shape as the shape of the first brushing assembly, and therefore has a curvature facing the same way.

It has been observed that, once the two propelling elements are disposed in this way in the tube, the forces that need to be exerted to cause the propelling elements to retreat towards the inlet of the tube are significantly larger than the forces necessary to cause them to advance further into the tube.

Causing a propelling element that is bearing against the inside periphery of the tube in the above-indicated manner to retreat would require the concavity of the propelling element to be reversed, and in any event would make it necessary to overcome the axial component (directed towards the outlet of the tube) of the reaction forces from the tube on the edges of the propelling element that are inclined towards the inlet of said tube.

Therefore, it has been observed that, with the two brushing assemblies being disposed one behind the other in the tube, when an attempt is made to increase the distance between them, the first brushing assembly (the assembly that is closer to the outlet) advances further along the tube, while the second brushing assembly remains substantially at its initial place. When an attempt is then made to reduce the distance between two brushing assemblies, the first brushing assembly does not retreat or hardly retreats, but rather it pulls the second brushing assembly towards it so that said second assembly advances further along the tube. Thus, stepwise, it is possible merely by moving the two brushing assemblies towards each other and away from each other in alternating manner to cause said assemblies to advance along the tube to its outlet end opposite from its inlet.

The reservoir is taken on board the cleaning system inside the tube, so that it is necessary merely to fill it at the beginning of the cleaning operations with a quantity of fluid suitable for the length of the tube to be cleaned, so as to guarantee that fluid is sprayed all the way along one complete pass of the brushing assemblies along the tube.

Fluid is advantageously sprayed via rotary jets so as to spray the entire periphery of the tube properly.

During the first pass of the brushing assemblies, spraying a detergent oil, for example, makes it possible to remove properly all of the dirt that adheres to the inside periphery of the tube after it has been used. In particular such dirt is constituted by powder in gun barrels, or by fat in garbage chutes.

After at least a first pass of the brushing assemblies with fluid being sprayed, the inside periphery of the tube is advantageously wiped with an absorbant material disposed on each of the two brushing assemblies. The absorbant material may be a piece of fabric, a piece of paper, a rag, or the like that is placed on each brushing assembly or optionally in place of each brushing assembly.

Advantageously, for cleaning helical grooves that are formed in the inside wall of said tube, the brushing means of one brushing assembly are allowed to rotate freely relative to the brushing means of the other brushing assembly.

In a particularly advantageous embodiment, the device has a first support element on which one of the brushing assemblies is mounted, and a second support element on which the other brushing assembly is mounted, and means for causing said support elements to slide relative to each other along the axial direction, by bringing them towards each other and away from each other in alternation. The above-mentioned support system thus comprises these two support elements and means for causing them to slide relative to each other.

For example, the two support elements may be rods or a rod and a ring suitable for sliding one on the other, or two support pieces interconnected by a retractable and extendable rod.

Advantageously, the first and second support elements are respectively secured to a piston portion and to a cylinder portion of a jack.

Advantageously, the jack is a jack driven by fluid under pressure, and it has a body provided with means for alternately connecting control chambers for controlling the movement of the piston portion to a fluid feed and to a fluid discharge.

The jack may be controlled hydraulically or pneumatically, or else by mechanical means such as a link system or the like, which means are driven by a motor, e.g. an electric motor.

These and other features of the present invention will become apparent upon review of the following detailed description of the preferred embodiments when taken in conjunction with the drawings and the appended claims.

BRIEF DESCRIPTION OF THE DRAWINGS

The invention will be better understood and its advantages will appear more clearly on reading the following detailed description of an embodiment shown by way of non-limiting example. The description refers to the accompanying drawings, in which.

DETAILED DESCRIPTION OF THE INVENTION

Figure 1:
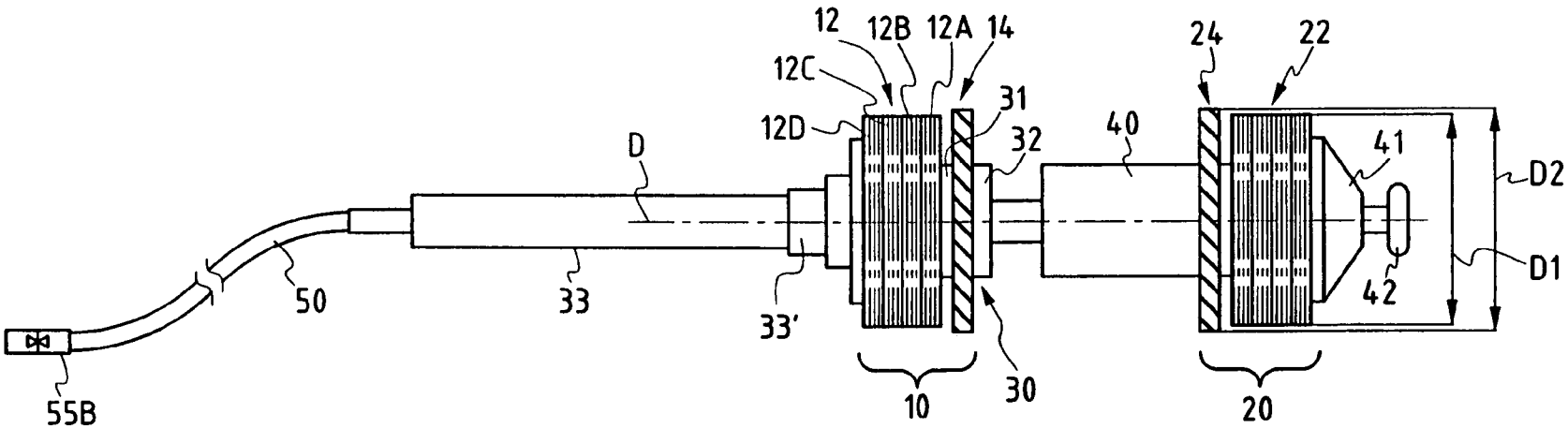
FIG. 1 is an elevation view showing device of the invention.

The device shown in FIG. 1 comprises two analogous brushing assemblies, respectively referenced 10 and 20. Each of the assemblies comprises brushing means, respectively 12 and 22, and a propelling element, respectively 14 and 24. The device is designed to clean the inside periphery of a tube. In the following description, the axial direction D is the geometrical axis along which the device of the invention moves inside the tube, which axis coincides with the longitudinal axis of the tube. The brushing means thus extend transversely to said axial direction D, and the bristles of the brushes extend radially so that they can rub against the inside periphery of the tube. The propelling elements 14 and 24 are also disposed transversely to the axis D. For example, each of the brushing means 12 or 22 comprises a plurality of series of brushing disks disposed in succession, and having different brushing effects. Thus, it is possible to provide a first brush 12A that is made of Nylon®, a second and a third brush 12B and 12C made of brass, and a fourth brush 12D made of bronze.

The device of the invention is designed to clean tubes of circular or substantially circular cross-section. The tubes may also be very slightly conical. In order to obtain the brushing effect, the diameter D1 of the brushing means must be slightly larger than the inside diameter of the tube that the device is designed to clean. Thus, as shown in FIG. 2, when the device is inserted in the tube 1, the brushes of the brushing means 12 and 22 are flexed towards the inlet 1A of the tube, i.e. backwards relative to the direction F in which they are inserted into the tube.

The propelling elements 14 and 24 are also of diameter D2 that is larger than the inside diameter $D_T$ of the tube 1. Said diameter D2 is at least equal to or slightly larger than the diameter D1. FIG. 2 also shows that, when the device is inserted in the tube, the propelling elements 14 and 24 are arched so as to have concave faces facing towards the inlet 1A of the tube.

The brushing assemblies 10 and 20 are mounted so that they can be moved axially relative to each other, towards each other and away from each other in alternation.

Figure 2:
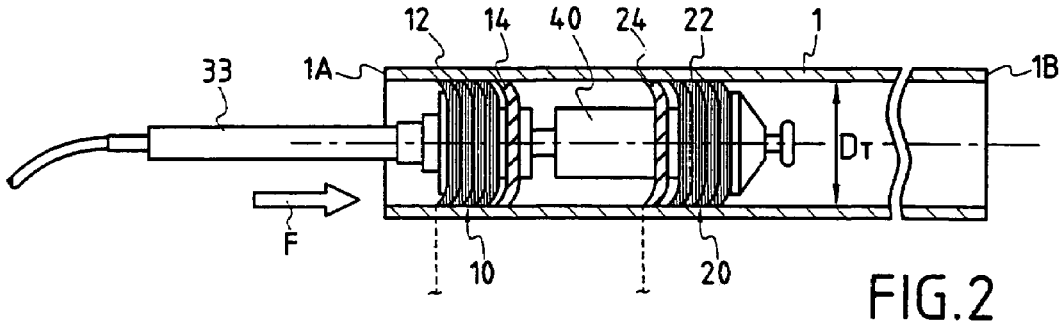
FIGS. 2, 3, and 4 show three successive stages in using the device for cleaning a tube.
Figure 3:
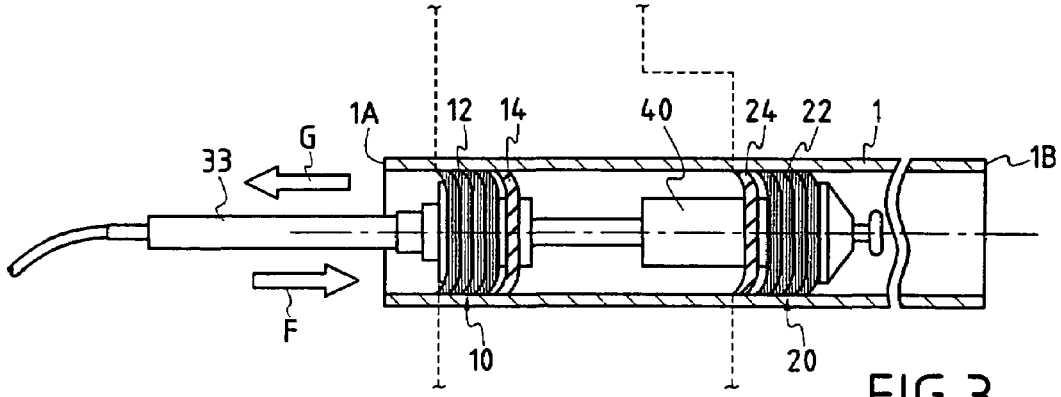

Thus, starting from the situation in FIG. 2, it is possible to move the assemblies 10 and 20 apart as shown in FIG. 3. Said assemblies 10 and 20 are analogous, i.e. they are chosen so as to exert substantially the same reaction forces against the inside periphery of the tube 1 when they are inserted in it. In addition, the resistance opposed by the brushing assemblies to their advancing in the direction F into the tube is lower than the resistance that they opposed to their retreating in the direction G. This is due to the direction in which their concave faces face. Due to the way the edges of the propelling elements are oriented, the friction forces that oppose retreat are higher than the forces that oppose advance. Retreat requires the concavity to be reversed, whereas the direction of concavity is preserved during advance.

Figure 4:
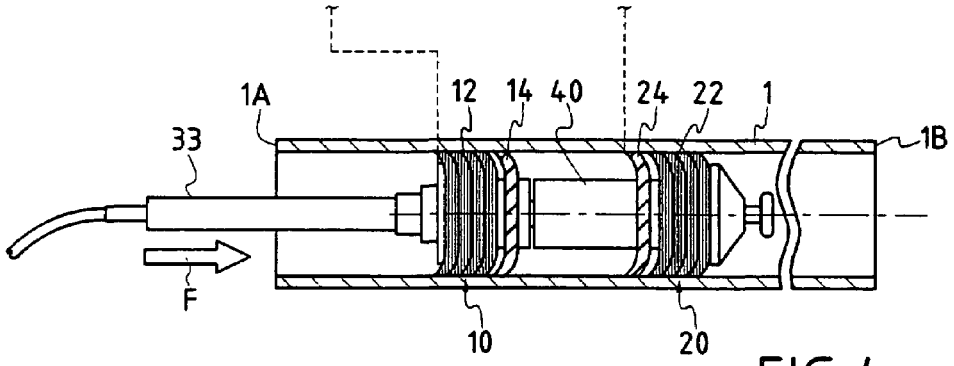

Thus, when the assemblies 10 and 20 are moved apart, the assembly 10 (the assembly nearer the inlet 1A of the tube) does not tend or hardly tends to retreat, and it is the assembly 20 that advances, as shown by comparing FIGS. 2 and 3. When the assemblies 10 and 20 are then moved back towards each other, the assembly 20 does not tend or hardly tends to retreat, and it is the assembly 10 that advances, as shown by comparing FIGS. 3 and 4. It can thus be understood that by alternating moving the assemblies 10 and 20 together and moving them apart, it is possible, to cause the device to advance stepwise to the outlet 1B of the tube.

In order to make the present description clearer, the function of the propelling elements 14 and 24 is distinguished from the function of the brushing means 12 and 22. However, the propelling elements may be relatively rigid brushes. It has been observed that brushes having bristles that are extremely fine or of low rigidity, tend to twist inside the tube after a first advance stage, by being placed substantially in a radial plan, in which case the concavity of the above-mentioned concave faces tends to disappear. It is then no longer possible to cause the two brushing assemblies to advance in the tube in the above-indicated manner. However, it is possible to choose to use a sufficiently rigid brushing element as a propelling element, e.g. a brush whose bristles are sufficiently thick and dense to conserve the axial flexing that is imparted to them on being inserted into the tube. The person skilled in the art can perform tests to determine the nature, the diameter, and the density of the suitable bristles. The propelling element 14 or 24 may be a brush analogous to one of the above-mentioned brushes 12A to 12D whose rigidity is determined appropriately.

Providing the propelling element in the form of a brush offers the advantage of enabling said brush to participate in cleaning the tube or at least of preventing the grooves in the inside periphery of the tube from being clogged by contact between said inside periphery and the outside periphery of the propelling element.

It is also possible to choose a plate suitable for being deformed perpendicularly to its plane as the propelling element. For example, the propelling elements 14 and 24 are plates in the form of disks made of a synthetic material such as elastomer, said material being chosen so as to be of relative rigidity or of elasticity such that, once the propelling element is inserted into a tube and has concavity facing the inlet of said tube, the concavity is difficult to reverse inside the tube.

The brushes 10 and 20 are mounted on a support system such that the brushing means of one brushing assembly can turn freely relative to the brushing means of the other brushing assembly. For example, the brushes are mounted on bushes whose inside peripheries are cylindrical. The support elements 30, 40, or 35, 45 (see FIG. 9) have cylindrical outside surfaces on which said bushes are disposed.

It is indicated above that the two brushing assemblies 10 and 20 are analogous, and, in any event, have substantially the same resistance to advancing inside the tube. However, it is possible, for example, to choose relatively flexible "soft" brushes for the brushing means 22, while harder brushes are chosen for the brushing means 12. In which case, the propelling elements 14 and 24 are chosen so as to offer resistance to advance such that the difference in resistance to advance between the brushing means 12 and 22 is compensated if it is not negligible.

The brushing assemblies 10 and 20 are respectively mounted on first and second support elements 30 and 40. The two support elements can slide relative to each other so as to be brought towards each other or away from each other in alternation. For example, the first support element 30 is secured to a piston portion of a jack, while the second support element 40 is secured to a cylinder portion of the jack.

In FIG. 1, the brushes 12A to 12D are mounted in succession on the cylindrical surface of the piston portion 30, and they are held by an axial abutment ring 31. The propelling element 14 is held against said ring by another axial abutment ring or by a shoulder 32. The brushes and the propelling element of the other brushing assembly are mounted in the same way on the body 40 forming the cylinder of the jack 40'. At the end of said jack, they are held by an abutment washer 41 which is provided with a pull system 42 (ring, mushroom-shaped head, etc.).

Figure 6:
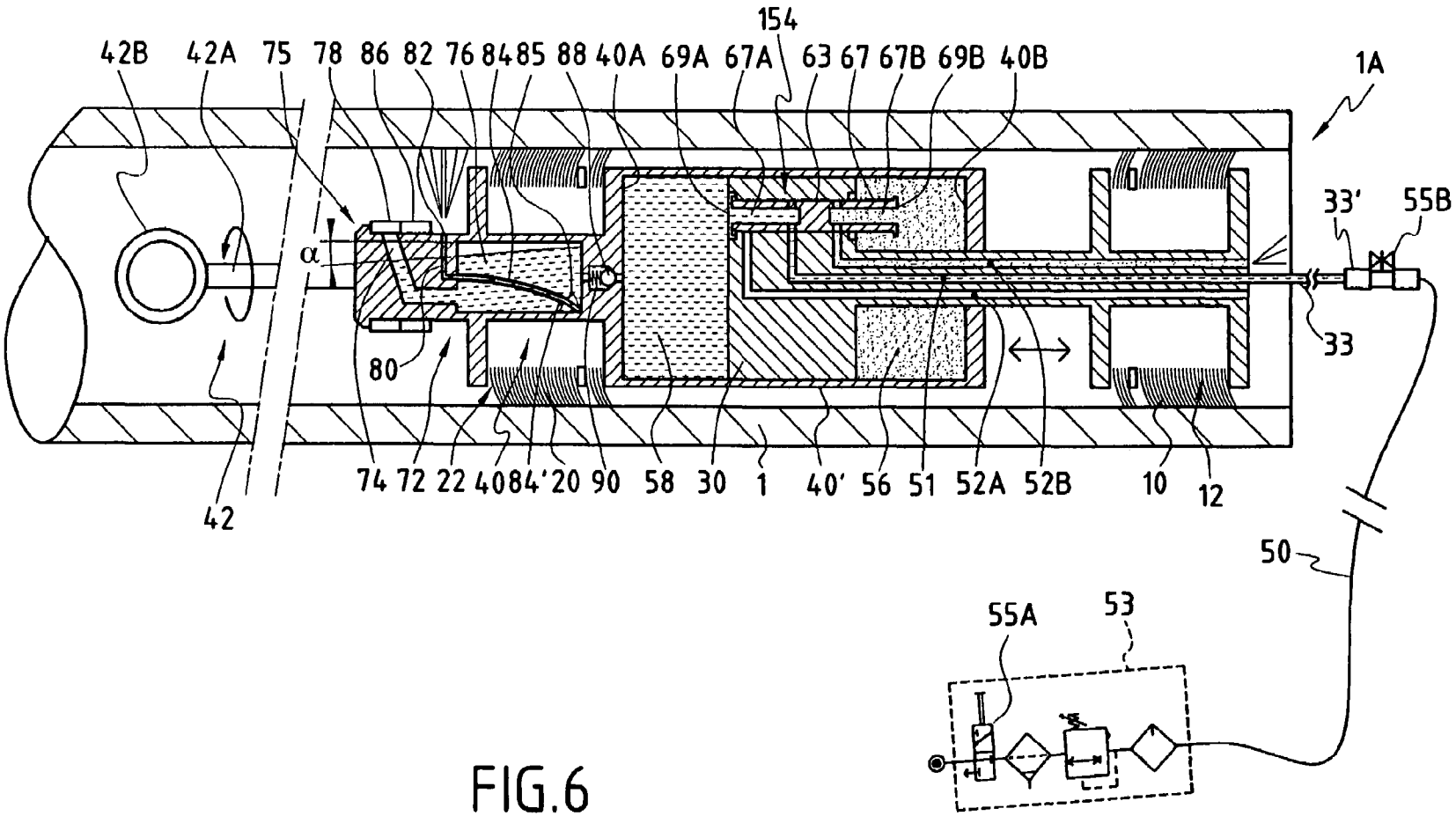
FIG. 6 is an axial section view of the device while it is operating as inserted in a tube.
Figure 7:
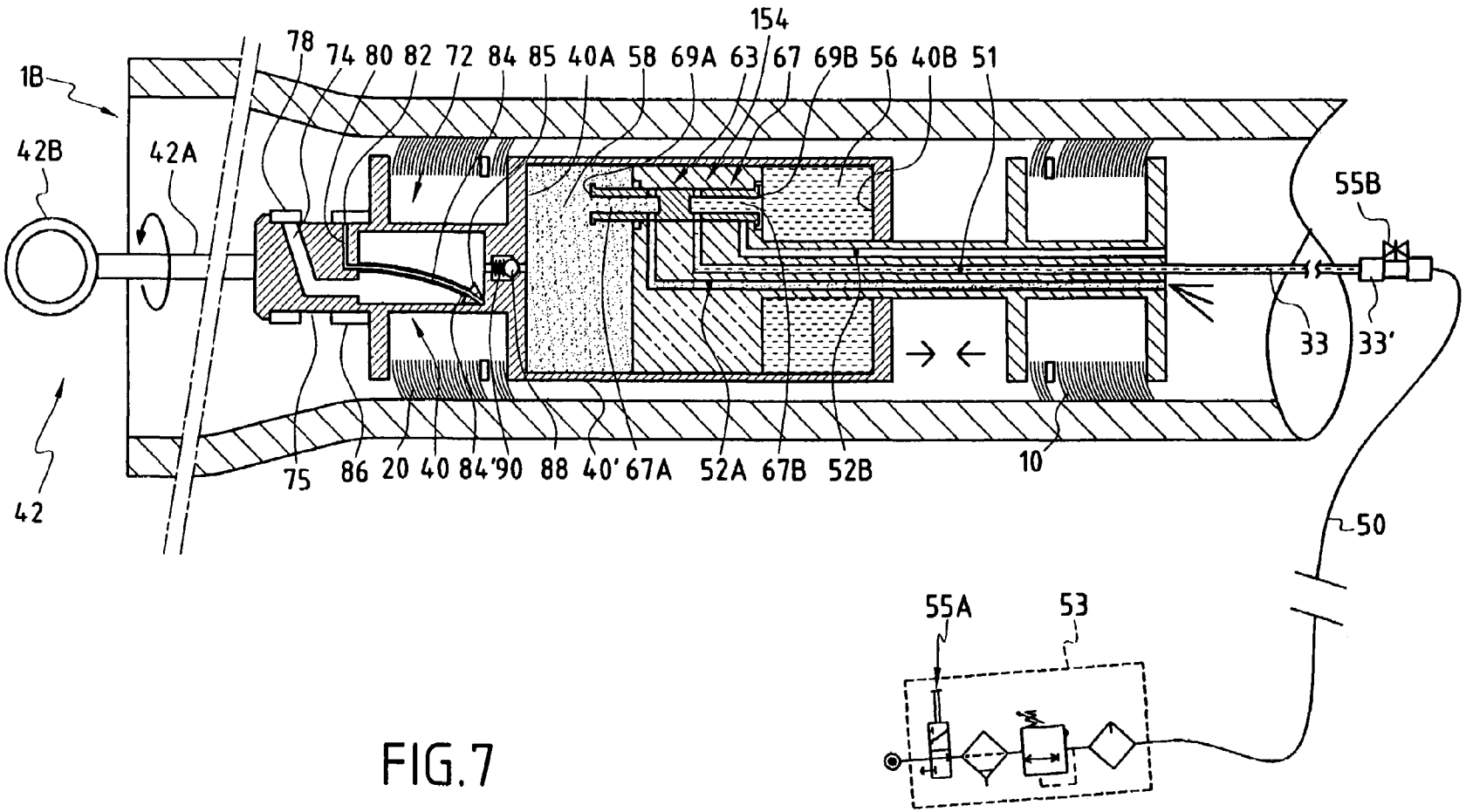
FIG. 7 is a section view analogous to FIG. 6 in another operating situation.

FIGS. 6 and 7 show a variant embodiment of the pull system 42 which comprises a rod 42A and a ring 42B. The brushing assembly 20 is extended by the rod 42A whose end is equipped with the ring 42B which may also be in the form of a ball, which projects from the second end 1B of the tube 1 when the brushing assembly 20 reaches the vicinity of said end, which makes it possible to take hold of the brushing assemblies 20 that are to be pulled out of or pushed back into the tube 1 without having to insert the hands into the tube 1.

The device can be engaged into the tube by being manipulated via the shank 33 situated at that end of the brushing assembly 10 which is further from the brushing assembly 20. Once the device is engaged in the tube, it is possible to perform a brush and advance step in which brushing takes place and in which the brushing assemblies advance towards the second end 1B of the tube as indicated above.

At the end of this step, the first brushing assembly (assembly 20 in this example) reaches the second end 1B of the tube. It is then possible to brush the tube once again by causing the device to move in the reverse direction. For this purpose, the two brushing assemblies 10 and 20 are extracted from the tube, and they are reinserted into said tube via the second end 1B so that the brushing means co-operate with the inside periphery of the tube and so that the two propelling elements co-operate with said inside periphery by being flexed axially towards the second end 1B of the tube. A brush and advance step is then performed in which brushing takes place and in which the brushing assemblies are caused to advance towards the first end of the tube by moving the brushing assemblies towards each other and away from each other in alternation. By means of the assemblies moving towards each other and apart in this way, the device advances towards the inlet 1A of the tube because the concave faces of the propelling elements face towards the outlet 1B.

When the device reaches the outlet 1B of the tube after the first brush and advance step, the end portion 42 is accessible and, sometimes, the brushing assembly 20 emerges from the tube or is situated in a chamber having a larger diameter. Even if the assemblies continue to move towards each other and away from each other, the brushing assembly 10 no longer advances towards the outlet because the brushing assembly 20 no longer bears against the inside periphery of the tube. In order to extract the device from the tube, it is therefore necessary to pull on the pull end 42, e.g. by means of a rope.

When extraction is complete, it is then possible to reinsert the assembly in the manner described above.

Preferably, a rotary coupling is provided between the support system for supporting the brushing assemblies 10, 20 and the control means (pipe 50 or sheath 66 and cable 64) for causing the brushing assemblies to move in alternating manner relative to each other. Thus, the shank 33 is equipped with a rotary fitting 33' that is impermeable to compressed air, and that enables the pipe 50 to be rotated at the same time as the brushing assembly 10.

The jack used to cause the brushing elements 10 and 20 to move may be a jack driven by fluid under pressure, e.g. compressed air. In which case, the jack control system comprises means for feeding in fluid under pressure and means for discharging said fluid, which means are themselves controlled so as to urge the piston to move alternately in either direction.

Thus, FIG. 1 shows a compressed air pipe 50. Operation of the device can be stopped by a stop valve 55B that prevents the compressed air from flowing. For example, when the device is used to clean gun barrels equipped with compressors, it is possible to use the compressed air delivered by the compressor to actuate the jack.

Figure 5:
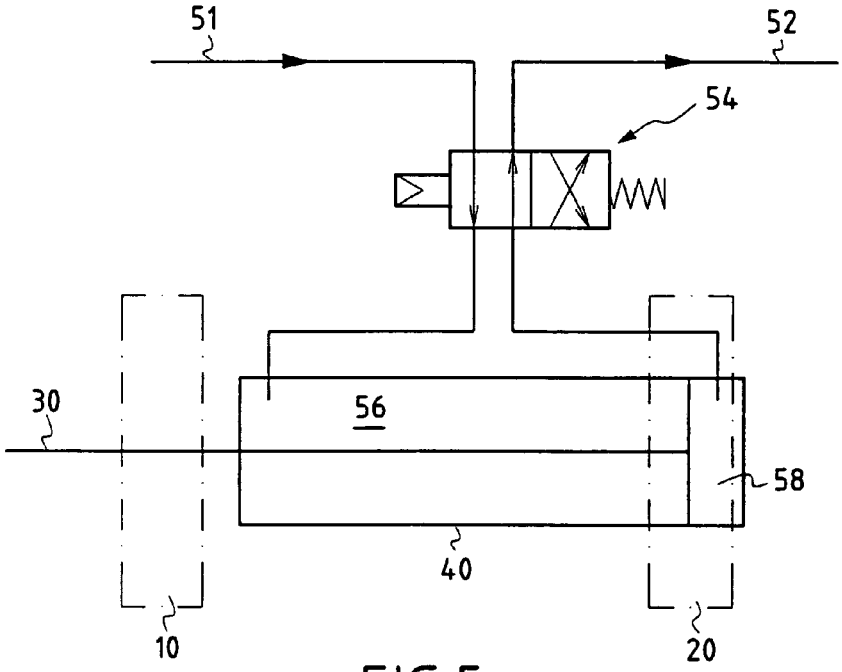
FIG. 5 is a diagram showing control means that may be considered for the device of the invention.

In FIG. 5, the brushing assemblies 10 and 20 are indicated in chain-dotted lines. They are respectively secured to the piston 30 and to the body 40 containing the cylinder of the jack 40'. The ducts 51 and 52 serving respectively for feeding in the fluid under pressure and for discharging the fluid are indicated.

The control means for controlling the jack comprise a valve 54 having two positions and two control chambers, respectively 56 and 58, disposed on either side of the piston 30.

When the valve 54 is in the first position, as shown in FIG. 5, the feed duct 51 is connected to the chamber 56, while the discharge duct 52 is connected to the chamber 58, so that the piston is pushed into the cylinder. When the valve 54 in the other position, the situation is inverted, and the piston 30 is controlled so as to move out of the cylinder.

For example, the valve 54 is controlled by fluid under pressure, e.g. compressed air, against return means.

Advantageously, said valve 54 is disposed directly inside the body of the jack. It is possible to choose a valve 54 that is implemented so as to invert the air feed and air discharge automatically each time the piston 30 of the jack reaches the end of its stroke, in which case only one control duct 51 serving to feed in the compressed air is necessary.

Figure 8:
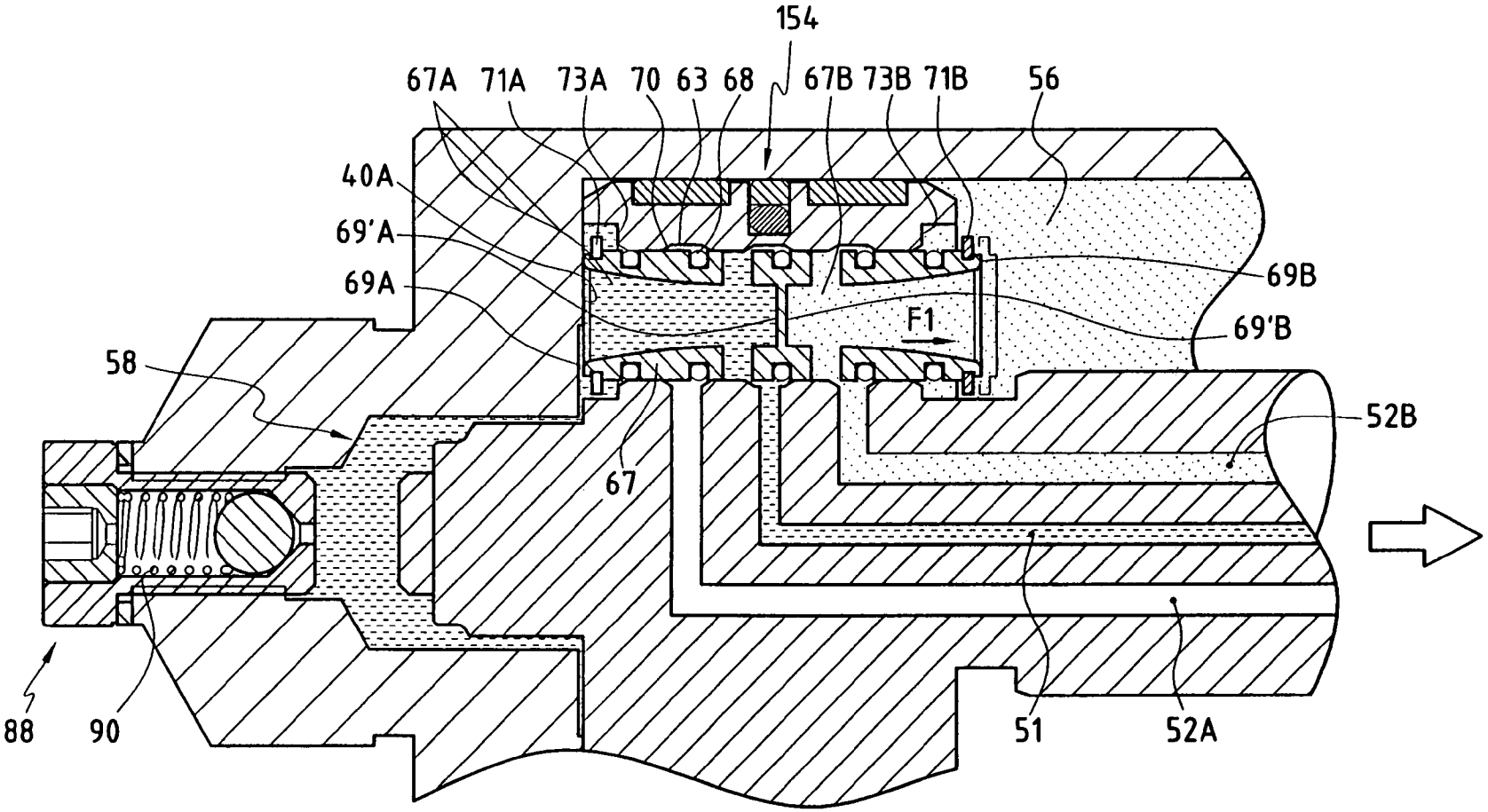
FIG. 8 is a fragmentary section view of the device showing a detail of its design.

FIGS. 6 to 8 show in detail a variant embodiment of the valve 54, referenced 154 in these three figures.

In this variant, the fluid discharge comprises two discharge ducts 52A and 52B that can be connected to respective ones of the chambers 58 and 56. The two discharge ducts 52A and 52B pass through the piston 30 and its rod to open out in the surrounding air in the rear face of the brushing assembly 10.

The compressed air coming from the compressor passes through an air treatment system 53 provided with an isolating valve 55A. The compressed air duct 50 serving to feed the two chambers 56 and 58 in alternation is connected between the isolating valve 55A and the stop valve 55B of the open-and-shut type which is secured to the shank 33. Said stop valve 55B is actuated manually at the inlet of the tube 1A while the brushing assemblies 10 and 20 are being inserted or extracted, and it enables the movement of the piston to be triggered or stopped.

In order to make it possible to keep the air treatment system 53 out of the tube 1, the compressed air pipe 50 is of length sufficient to follow the brushing assemblies 10 and 20 over the entire length of the tube.

When the stop valve 55B is in the open position, the compressed air flows inside the shank 33, and then into the feed duct 51 via the rotary fitting 33'.

As shown in FIGS. 6 to 8, the feed duct 51 opens out in a bore 63 formed in the piston 30. A slide 67 that is preferably cylindrical, and that is provided with two compartments 67A and 67B slides inside the bore 63 between two positions that are stable relative to the piston, so as to direct the compressed air successively into each of the two chambers 56 and 58 depending on its position.

When the slide is in a first stable position, shown in FIG. 6, corresponding to the chamber 58 being fed, the feed duct 51 is connected to the compartment 67A, while the chamber 56 is connected to the discharge by means of the compartment 67B being connected to the discharge duct 52B. In this position, the slide 67 projects from the piston 30 into the chamber 56 and the discharge duct 52A is unused.

Conversely, when the slide is in a second stable position, shown in FIG. 7, corresponding to the chamber 56 being fed, the feed duct 51 is connected to the compartment 67B, while the chamber 58 is connected to the discharge by means of the compartment 67A being connected to the discharge duct 52A. In this position, the slide 67 projects from the piston 30 into the chamber 58, and the discharge duct 52B is unused.

Advantageously, said valve 154 is provided with means for urging said slide 67 to move, said means comprising first abutment means formed on said slide 67, and second abutment means formed in each of the chambers 56 and 58 suitable for co-operating with said first abutment means.

FIG. 8 shows the slide 67 and the abutment means in detail while the slide is going from the position shown in FIG. 7 to the position shown in FIG. 6. Each time the piston 30 comes to the end of its stroke, the slide 67 automatically changes position by coming into abutment alternately against the walls 40A and 40B formed respectively in the chambers 58 and 56 inside the cylinder 40'. The changing of position, and the holding in either one of the two stable positions is accentuated by the air pressure that is exerted alternately on walls 69A and 69'A formed at the ends of the compartment 67A, and alternately on walls 69B and 69'B formed at the ends of the compartment 67B.

In order to limit the stroke of the slide 67 during a change of position, a stop against movement in translation is provided at the end of each of the compartments 67A and 67B. Thus, the slide 67 cannot come out of the bore 63, and the feed duct 51 and the discharge duct 52A or 52B always come into register with the connections of the purpose-built compartment. The two stops may be achieved with a ring 71A or 71B disposed at the periphery of the end of the compartment 67A or 67B, so as to project radially from the compartment 67A or 67B, and so as to be capable of coming into contact with a shoulder 73A or 73B provided on the piston 30 in the chamber 58 or 56.

In order to improve the movement of the slide 67 in the bore 63, it is preferably made of polyoxymethylene homopolymer (POM H), e.g. of the type sold under the DELRIN® trademark. The use of this material makes it possible to reduce friction and inertia, so as to reduce the force required to move the slide 67.

In addition, provision is made to minimize the stroke of the slide 67, preferably by limiting it to 6 millimeters (mm).

In order to provide sealing between the feed duct and the discharge duct 51, 52A, and 52B, the slide 67 has O-ring seals 68. In order to limit the friction between the O-ring seals 68 and the wall of the bore 63, said wall is provided with grooves 70 so as to limit the contact between said O-ring seals 68 and said wall. Said grooves 70 are situated in zones in which, for a given position of the slide 67, sealing is momentarily unnecessary.

Thus, when the slide 67 comes into abutment against the end wall 40A of the chamber 58, the chamber 58 starts to be put under pressure by being progressively connected to the duct 51, as shown in FIG. 8, and the chamber 56 starts to be connected to the discharge by being progressively connected to the duct 52B. When the slide 67 comes into abutment, most or all of the seals 68 are not in leaktight contact with the bore 63, so that the friction of the slide 67 in the bore 63 is very low, and the movement in the direction F1 initiated by the slide coming into abutment continues by a dynamic effect until said slide 67 reaches its stable position shown in FIG. 6.

In order to increase the effectiveness of cleaning of the tube 1, the device is equipped with a spray system 72, 74, 78, 80, 82, 84, 85, 86 for spraying a fluid 76 (detergent, lubricant, etc.) shown in FIGS. 6 and 7.

Said spray system 72, 74, 78, 80, 82, 84, 85, 86 formed in the front portion of the device beyond the first brushing assembly 20 comprises a reservoir 72 situated in the support element 40. The reservoir 72 is connected to a filling orifice 74 opening out at the periphery of the free cylindrical end 75 of the support element 40 which makes it possible fill the reservoir 72 with fluid 76 (lubricant, cleaning fluid, etc.), e.g. by means of a metering hopper containing the quantity sufficient to clean the tube 1. Said quantity is preferably determined to perform a go pass in the tube 1 and so that the reservoir 72 is completely empty at the end of the pass so as to avoid untimely spraying of the fluid 76. Since the reservoir 72 is rotated when the support 40 turns in the helical thread formed in the tube, for example, it is necessary to be able to close off the filling orifice 74 with a stopper 78.

In order to enable the fluid 76 contained in the reservoir 72 to be sprayed in forced manner, said reservoir is connected to the periphery 75 of the brushing element 20 via spray means.

The spray means comprise a duct that connects the inside of the reservoir 72 to at least one fluid outlet 80, and spray nozzles 82. A pipe 84 enables said duct to be connected to the fluid 76. The spray nozzles 82 can be closed off with a stopper 86 during filling or after use to prevent the fluid 76 from evaporating. The presence of the two stoppers 76 and 78 makes it possible to use the cleaning device without spraying. FIG. 7 shows this configuration of the cleaning device with the reservoir 72 empty.

In this example, the stoppers 78 and 86 are rings which can slide over the cylindrical end 75. It is possible to consider providing a single ring in place of the rings 78 and 86, which ring alternately closes off the filling orifice 74 and/or the spray nozzles 82.

The pipe 84 is made of a flexible material, preferably a fluorocarbon elastomer (FPM). Advantageously, the end 84' of the pipe 84 which dips into the fluid 76 remains substantially stationary in rotation despite the reservoir 72 rotating. For this purpose said end 84' is made heavier by a weight 85. The flexibility of the pipe 84 used combined with the presence of the weight 85 enables the pipe 84 to remain at the bottom of the reservoir 72 while said reservoir is rotating with the brushing assembly 20. When the device does not turn, said weight 85 offers the advantage of holding the inlet end 84' at the bottom of the reservoir 72 regardless of the initial angular position of the device when the brushing assemblies 10, 20 are inserted into the tube 1.

The device is inserted into the tube to be cleaned preferably inclined at a small angle (e.g. at an angle equal to 40°) relative to the horizontal, so as to give access to it at man height so that it can be cleaned. Thus, the inlet 1A is lower than the outlet 1B of the tube 1, and the reservoir 72 is also slightly inclined, which causes the fluid 76 to be inclined. Thus, even at the end of use, when very little fluid 76 remains, the pipe 84 remains in contact with said fluid.

As shown in FIG. 8, the reservoir 72 is filled in part with the fluid 76 maintained under pressure by drawing off compressed air from the chamber 58. A valve member 88 that is calibrated by means of a spring 90 is disposed between the chamber 58 and the reservoir 72. If the jack operates under a pressure of 5 bars, it is possible, for example, to pre-set the valve member to open at 4 bars. In this way, the pipe is fed continuously with the fluid 76 so that the fluid 76 is sprayed in alternation via the spray nozzles 82 onto the inside wall of the tube 1 via jets that follow the rotation of the brushing assembly 20.

For one half of the time for which it is use, the chamber 58 is not fed under pressure, but rather it is in a discharge stage. However, the pressure in the reservoir 72 remains sufficient to force the fluid 76 to be sprayed during said stage, until the chamber 58 is under pressure once again.

When the device is not rotatably mounted, in particular when the tube 1 is smooth, the spray nozzles 82 are rotated by specific means (not shown) that are free to turn relative to the support element 40 containing the reservoir 72 under the effect of the pressure of the fluid 76. In which case, rotary sealing is preferably disposed between said specific means and the support element 40 in the vicinity of the reservoir 72.

The preferred operating mode consists in causing the brushing assemblies 10 and 20 to travel over a go first pass while the fluid 76, e.g. a detergent fluid, is being sprayed, thereby enabling any dirt adhering to the inside wall of the tube 1 to be removed properly. The return pass preferably takes place dry.

A second cycle of go and return passes of the brushing assemblies 10 and 20 is performed dry.

Each of the brushing assemblies 10 and 20 is then covered with an absorbant material (not shown), in the form of a fabric or of paper, for example, held on the device, and a go-and-return cycle of the device is performed to remove all of the fluid 76 sprayed, and any dirt that is still present. The brushing assemblies 10 and 20 may be replaced entirely with said absorbant material.

The absorbant material is withdrawn and replaced with an analogous (or identical) material for performing a go pass in the tube 1 with fluid 76, e.g. a lubricant, being projected. The return pass is performed without fluid 76 being sprayed so as to soak up the surplus fluid 76, in particular when the tube has grooves which can accumulate the fluid 76 sprayed during the preceding pass.

Figure 9:
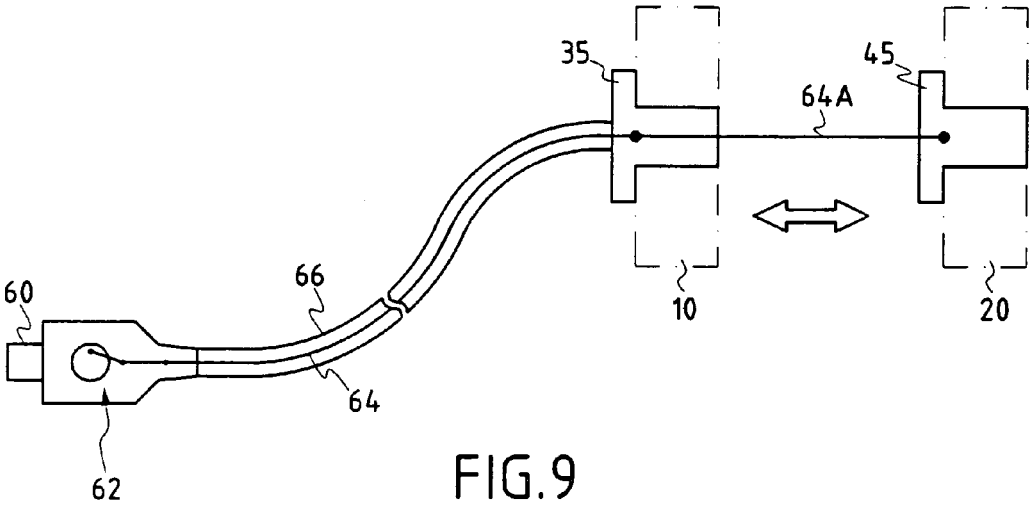
FIG. 9 is a diagram showing a variant embodiment.

FIG. 9 shows a variant configuration for mounting the two brushing assemblies 10 and 20 and for moving them relative to each other. They are mounted on support pieces, respectively 35 and 45. The control means for controlling the movement comprise a motor 60, e.g. an electric motor, and means for transmitting the movement. For example, said means comprise a link 62 which is driven by the motor to transmit reciprocating linear motion to a cable 64. The cable is disposed in a sheath 66 to the end of which the support piece 35 is fixed. The sheath 66 is flexible while being sufficiently rigid not to tend to deform axially by crumpling up on itself.

The end portion 64A of the cable 64 is fixed to the support piece 45. Since the support piece 35 is held by the sheath 66, it can be understood that the axial movements of the cable 64 generated by the link 62 tend to move the two support pieces 35 and 45 towards each other and away from each other in alternation. With this variant, it is possible to choose a sheath 66 that is sufficiently long for the motor 60 to remain outside the tube while said tube is being cleaned. For cleaning tubes of sufficiently large dimensions, it is also possible to use an "on-board" motor fixed to the support piece 35, which motor is provided with a feed that is also on-board, or else it is connected to an external feed via a flexible cable.

FIGS. 1 to 4 show the two propelling elements 14 and 24 disposed between the brushing means 12 and 22. This is one embodiment, but it is naturally also possible to chose some other configuration, e.g. by disposing the propelling element 24 against the washer 41, i.e. at that end of the brushing assembly 20 which is further from the brushing assembly 10.

For example, for cleaning a tube having an inside diameter of 15 mm, and provided with helical grooves taking its diameter at the bottoms of the grooves to 158 mm, and having a length approximately in the range 6 m to 10 m, it is possible to use device comprising three or four brushing elements, respectively made of Nylon®, of brass, and of bronze for each brushing assembly. As the propelling element, it is possible to choose two disks made of polyamide and having a diameter equal to 160 mm, and made of an elastomer such as Viton® and having a thickness of 5 mm. it is also possible to choose a propelling disk formed by a brush having a diameter of 164 mm, having a thickness of 16 mm and whose polyamide bristles have a diameter of 1 mm.

It should be apparent that the foregoing relates only to the preferred embodiments of the present invention and that numerous changes and modifications may be made herein without departing from the spirit and scope of the invention as defined by the following claims and the equivalents thereof.

What is claimed is:

1. Device for cleaning a tube, said device comprising:

two analogous brushing assemblies, each of which comprises brushing means suitable for co-operating with an inside periphery of the tube, and a propelling element for moving said brushing means inside the tube, means for moving axially the brushing assemblies towards each other and away from each other in alternation, and a spray system for spraying a fluid against the inside periphery of the tube; said propelling element being suitable for co-operating with said inside periphery by being flexed along an axial direction (D) of the tube, in that said brushing assemblies being mounted on a support system; in that said means for moving axially the brushing assemblies towards each other and away from each other in alternation comprising a control chamber which is secured to said support system and which may be connected to a feed for feeding in fluid under pressure, and said spray system including a reservoir which co-operates with said support system which is on board with said support system and which can be put under pressure by being connected to said chamber.

2. Device according to claim 1, wherein said brushing means of one of said brushing assemblies are suitable for turning freely relative to the brushing means of an other one of said brushing assemblies so that each of the brushing means can clean helical grooves formed in the inside periphery of said tube by advancing in a helical thread formed by said grooves.

3. Device according to claim 1, wherein said spray system is secured to said brushing means of one of said brushing assemblies.

4. Device according to claim 1, wherein said reservoir comprises a filling orifice serving for filling said reservoir with fluid and said spray system further comprises a fluid outlet having at least one spray nozzle distributed at a periphery of said support system for spraying said fluid against the inside periphery of the tube.

5. Device according to claim 4, wherein said fluid outlet comprises a plurality of spray nozzles distributed at the periphery of said support system.

6. Device according to claim 4, wherein said fluid outlet is connected to an inside of the reservoir via a pipe.

7. Device according to claim 6, wherein said pipe comprises a weight serving to keep said pipe immersed in the fluid contained in the reservoir.

8. Device according to claim 1, wherein said spray system further comprises a valve member which makes it possible to connect said chamber to said reservoir serving to put the fluid under pressure.

9. Device according to claim 1, wherein each propelling element comprises a plate suitable for being deformed perpendicularly to a plane thereof.

10. Device according to claim 1, wherein each propelling element comprises a brushing element.

11. Device according to claim 1, wherein said support system comprises a first support element on which one of the brushing assemblies is mounted, and a second support element on which an other one of said brushing assemblies is mounted, and means for causing said support elements to slide relative to each other along the axial direction (D), by bringing said support elements towards each other and away from each other in alternation.

12. Device according to claim 11, wherein the first and second support elements are secured respectively to a piston portion and to a cylinder portion of a jack driven by fluid under pressure.

13. Device according to claim 12, wherein said jack comprises a body provided with connection means for connecting together said control chamber and another chamber for controlling the movement of the piston portion to said fluid feed and to a fluid discharge in alternation.

14. Device according to claim 13, wherein said connection means comprise an inversion valve suitable for inverting the fluid feed and the fluid discharge automatically each time the piston reaches an end of a stroke so that the device is provided with a single control duct that serves as the fluid feed.

15. Device according to claim 14, wherein said inversion valve has a slide suitable for sliding in a bore formed in the piston of the jack.

16. Device according to claim 15, wherein said fluid discharge has two discharge ducts, in that said slide has two compartments, each of which communicates with a respective one of the two chambers, and wherein, as a function of a position of the slide, one of said compartments is connected to the fluid feed, and another one of said compartment is connected to one of the two discharge ducts.

17. Device according to claim 15, wherein said inversion valve comprises means for urging said slide to move, which means comprise first abutment means formed on said slide and second abutment means formed in each of the chambers and suitable for co-operating with said first abutment means.

18. Device according to claim 1, wherein the support system is connected via a rotary link to the means for causing the brushing assemblies to move in alternating manner relative to each other.

19. A method of cleaning a tube, in which method two analogous brushing assemblies are used, each of which comprises brushing means and a propelling element, said brushing assemblies are inserted successively into the tube via a first end of said tube, so that the brushing means co-operate with an inside periphery of the tube, said brushing means are moved and a brush and advance step is performed in which the brushing assemblies brush and advance towards a second end of the tube by moving the brushing assemblies towards each other and away from each other in alternation, and fluid is sprayed against said inside periphery of the tube, wherein, on inserting said brushing assemblies into the tube, the two propelling elements secured to a support system co-operate with said inside periphery by being flexed axially towards the first end of the tube, wherein said brushing assemblies are moved axially towards each other and away from each other in alternation by feeding at least one control chamber which is connected to a feed for feeding in fluid under pressure, wherein said fluid is disposed in a reservoir that co-operates with said support system, and wherein said fluid is put under pressure by using a pressure existing in said control chamber.

20. A method according to claim 19, wherein that, for the purpose of cleaning helical grooves formed in an inside wall of said tube, the brushing means of one of said brushing assemblies are allowed to turn freely relative to the brushing means of an other one of said brushing assemblies.

21. A method according to claim 19, wherein that, when a first one of said brushing assemblies reaches the second end of the tube, the two brushing assemblies are extracted from the tube, said brushing assemblies are re-inserted into the tube via said second end, so that the brushing means co-operate with the inside periphery of the tube, and so that the propelling elements co-operate with said inside periphery by being flexed axially towards the second end of the tube, and a brush and advance step is performed in which the brushing assemblies brush and advance towards the first end of the tube by moving the brushing assemblies towards each other and away from each other in alternation.

22. A method according to claim 19, wherein said fluid is sprayed via rotary jets.

23. A method according to claim 19, wherein said inside periphery of the tube is wiped using an absorbant material disposed on each of the two brushing assemblies.

24. Device according to claim 2, wherein said spray is secured to said brushing means of one of said brushing assemblies.

25. Device according to claim 16, wherein said inversion valve comprises means for urging said slide to move, which means comprise first abutment means formed on said slide and second abutment means formed in each of the chambers and suitable for co-operating with said first abutment means.

26. An apparatus for cleaning a tube, comprising:

a support system;

two brushing assemblies mounted on said support system;

a propelling element for moving said brushing assemblies inside the tube;

means for moving said brushing assemblies towards each other and away from each other in alternation mounted on said support system;

a spray system in communication with said brushing assemblies for spraying a fluid against an inside periphery of the tube;

said propelling element being suitable for co-operating with said inside periphery by being flexed along an axial direction (D) of the tube;

a control chamber which is secured to said support system and which may feed a fluid under pressure; and a reservoir which co-operates with said support system and which can be put under pressure by being connected to said chamber.

* * * * *